United States Patent [19]

Lueg et al.

[11] 4,315,242

[45] Feb. 9, 1982

[54] DEVICE FOR DETERMINING THE MOMENT WHEN COMPETITORS IN A RACE ARE PASSING THE FINISHING LINE

[75] Inventors: Heinz Lueg; Hanno Blackert; Dirk Wimmenauer, all of Aachen, Fed. Rep. of Germany; Winfried Hermanns, Lütticherstr. 181, D-5100 Aachen, Fed. Rep. of Germany

[73] Assignee: Winfried Hermanns, Aachen, Fed. Rep. of Germany

[21] Appl. No.: 133,838

[22] Filed: Mar. 25, 1980

[30] Foreign Application Priority Data

Apr. 7, 1979 [DE] Fed. Rep. of Germany ..... 2914137

[51] Int. Cl.[3] ..... G08C 21/00; G08G 1/01

[52] U.S. Cl. ..... 340/38 L; 340/23; 340/32; 340/323 R

[58] Field of Search ..... 340/23, 32, 38 L, 323 R, 340/152 T, 551; 324/207, 208, 222, 236, 239, 243, 247; 272/4, 5; 273/86 R; 235/92 TA

[56] References Cited

U.S. PATENT DOCUMENTS 3,526,886 9/1970 Lubich ..... 340/38 L
3,644,825 2/1972 Davis et al. ..... 324/207
3,697,996 10/1972 Elder et al. ..... 340/38 L
3,795,907 3/1974 Edwards ..... 340/323 R

FOREIGN PATENT DOCUMENTS 2141001 5/1972 Fed. Rep. of Germany .

*Primary Examiner*—James J. Groody
*Attorney, Agent, or Firm*—Spensley, Horn, Jubas & Lubitz

[57] ABSTRACT

Each competitor in a race is provided with a transmitter. At the finishing line, two receiving antennae (10,11) are mounted which, when the finishing line is passed, are responsive to the field of the corresponding transmitter and permit an accurate determination of the moment when the finishing line is passed. The two receiving antennae (10,11) are arranged so that their directional sensitivities are rectangular relative to each other. One of the two antennae is responsive to horizontal and the other to vertical fields. A signal (25) representing the passing of the finishing line is produced when the signal of the one receiving antenna (10) is above a high first threshold value (20) and the signal of the other receiving antenna (11) is below a low second threshold value.

9 Claims, 4 Drawing Figures

DEVICE FOR DETERMINING THE MOMENT WHEN COMPETITORS IN A RACE ARE PASSING THE FINISHING LINE

BACKGROUND OF THE INVENTION

1. Field of the Invention

The invention relates to a device for determining the moment when the finishing line is passed by competitors in a race in which each competitor is provided with a transmitter, said device comprising at least two receiving antennae at the finishing line and receivers connected to the receiving antennae.

The methods of electronic timing permit a very accurate determination of competition times. In many cases, however, the exact determination of the moment when the finishing line is passed, is critical. When a light barrier extending along the finishing line is used, and several competitors are passing the finishing line in a close order, it is only possible to indicate the exact moment of the passing of the line of the first competitor among several participants passing the line nearly at the same time. If light barriers are mounted vertically relative to the racing course, a mounting bridging the racing course must be erected at the finishing line. In car races, such a bridge is dangerous for the competitors and offers an obstruction of visibility for spectators. Moreover, it is disadvantageous for light barriers that the light transmitters and light receivers may become dirty and that manipulations and interferences by unauthorized persons are to be expected.

2. Description of the Prior Art

There has beek known a system for taking and indicating competition times (German Pat. Appln. Ser. No. 2141001) in which in the ground of the racing course at the finishing line two receiving antennae are mounted which consist of two adjacent conductor loops over which the competitors of a car race will drive consecutively. Each competitor is provided with a transmitter which transmits a selective characteristic. Receivers are connected to the receiving antennae and tuned selectively to the characteristics of the transmitters. When the receiving antennae are passed, the transmitters produce signals which are evaluated and which do not only allow to determine the passing of the finishing line but also to identify the corresponding competitor. The signals produced consecutively in the two antennae, when overtravelled, are added up. The resultant total signal curve contains three sequential voltage peaks. However, it is difficult to evaluate or identify such a signal curve with electronic means for the exact determination of the moment when the finishing line is passed. While the transmitter of each racing car approximately generates approximately the same time voltage curve at the antennae, the amplitudes of curves may considerably vary from each other subject to the different moments when the finishing line is passed. The reason for it may for inst. reside in the different transmitting powers of the individual transmitters or in the different distances of the transmitters from the racing course. If the signal for the passing of the finishing line is only produced after a regular sequence of three voltage peaks has been determined at the receiving antennae, the racing car has already passed the finishing line so that the indicated moment of the passing is not in exact agreement with the real moment of passing.

Moreover, the known antennae system is very sensitive concerning disturbances caused intentionally. E.g. it is possible to set up near the antennae system a transmitter which produces a signal curve comprising three voltage peaks to simulate a passing of the finishing line. The receiving system would be also responsive to such a stationary transmitter for it only analyses the total voltge curve of all three antennae in common, without screening as to whether the voltage maxima occur consecutively at the individual antennae.

It is the object of the invention to provide a device of the type stated at the outset hereof which permits to determine very quickly and exactly the passing of the finishing line and which is insensitive to short-distance and remote interferences in that it is only responsive to transmitters in motion rather than to stationary transmitters.

SUMMARY OF THE INVENTION

To solve said problem, it is provided according to the invention that two receiving antennae are arranged with their directional sensitivities being substantially rectangular with respect to each other and that a signal for the passing of the finishing line is produced when the signal of the one receiving atenna is above a high first threshold value, and the signal of the other receiving antenna is below a low second threshold value.

The signal of the first receiving antenna slowly rises with the approach of one transmitter to the receiving antenna to reach its maximum when the transmitter is at the closest distance from the receiving antenna and to die out again thereafter. In the vicinity of the finishing line in front of and behind the finish, the signal level of the first receiving antenna exceeds the first threshold value. This range is relatively large and not sufficient for an exact determination of the passing of the finishing line. The exact determination is performed by the second receiving antennae with a main receiving direction being rectangular to that of the first receiving antenna. The signal produced at the second receiving antenna by a competitor approaching the finish is rising with the nearing approach, to drop sharply to zero shortly before the finish is reached and to again rise as sharply as that upon the passage of the finishing line so as to subsequently fade out. The sudden drop of the signal during the passing of the finishing line is used for the accurate determination of the moment when the finish is reached. The evaluation of the signals of the two receiving antennae can be performed with simple technical means. Only two threshold switches are required to find out whether the two requirements of the AND-state are met.

The receiving antennae preferably are induction loops of which one is mounted substantially horizontally and the other substantially vertically. The planes of the induction loops may cross in the center of the loops.

The wave length of the transmitting signals should be large as compared to the length of the loops so as to avoid standing waves at the induction loops.

The characteristics of the individual transmitters reside in a selective frequency sent out by each transmitter and to which the corresponding receivers of the measuring means are tuned. Tuning may be achieved by quartz-controlled oscillators. Other characteristics are possible by different modulations of one sole transmitted frequency.

Preferably, the induction loops are embedded in the ground of the racing course and their main axes extend transversely to the direction of movement of the competitors. A receiving antenna mounted this way in or under the ground along the finishing line excludes interferences with the competitors or with the spectators. It is not visible and a high accuracy is ensured at the same time. It turned out that a transmitter existing in an area of a few angular degrees based on the vertical plane passing the common axis of the receiving antennae can be safely located. In fact, the signal for the passing of the finishing line is produced exactly when the corresponding transmitter is just above the finishing line below which the two receiving antennae are embedded in the ground.

The induction loops are preferably secured to one common support body, which may be a tube. Thus, the required dimensional stability of the two receiving antennae is realised and no deformations of the induction loops may occur with the embedding of the material in the ground. The wires of induction loops may be also fastened at the inner wall of the tube to protect them against damages and deformations.

BRIEF DESCRIPTION OF THE DRAWINGS

A preferred embodiment of the invention with reference to the FIGS. is fully explained hereinafter.

DESCRIPTION OF THE PREFERRED EMBODIMENTS

The illustrated device lends itself particularly to determining the passing of the finishing line during car races. To this effect, the individual cars are provided with transmitters emitting different frequencies each. Preferably, the transmitters are mounted under the bottom plates of the racing cars or in a recess at the bottom plate. Their main direction of radiation is vertically downward. The racing car forms a shield which prevents that a higher amount of radiation is emitted to the top and to the sides. Due to the small distance from the ground in case of racing cars the transmitter is very close to the ground so that a reduced transmitting power will do.

Figure 1:
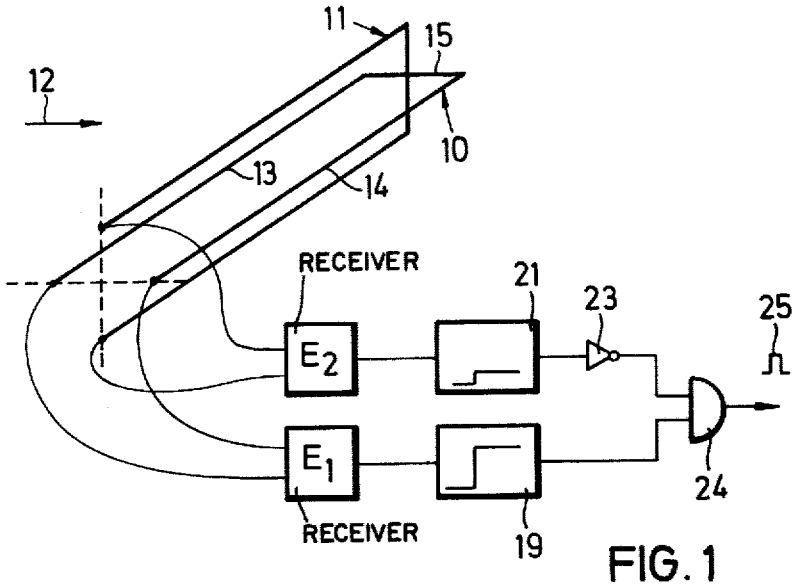
FIG. 1 is a basic view of the induction loops and of the evaluating means connected to the induction loops, FIGS. *2a* and *2b* show the curves of the different voltages in the range of the finishing line passed by the transmitter of a competitor.

Below the finishing line the two induction loops 10,11 are embedded in the ground of the racing course. In FIG. 1, the driving direction of the racing cars is marked with the arrow 12. The main directions of the induction loops 10 and 11 are transverse to the driving direction 12. Each induction loop consists of two parallel conductors 13, 14 which are connected at one end to a connecting conductor 15. The opposite ends of the conductors 13, 14 are connected to the evaluating device.

The conductors of the first induction loop 10 are in a substantially horizontal plane, while the conductors of the induction loop 11 are in a substantially vertical plane. The planes of the two induction loops are crossing in the loop centre.

The ends of the horizontal induction loop 10 are connected to a row of selective receivers $E_1$ of which one only is shown in FIG. 1. The ends of the vertical induction loop 11 are connected to a group of frequency-selective receivers of which also only one receiver $E_2$ is illustrated in FIG. 1. To each transmitter or racing car, a pair of receivers $E_1$, $E_2$ is assigned and tuned to the frequency of the corresponding transmitter.

Figure 2:
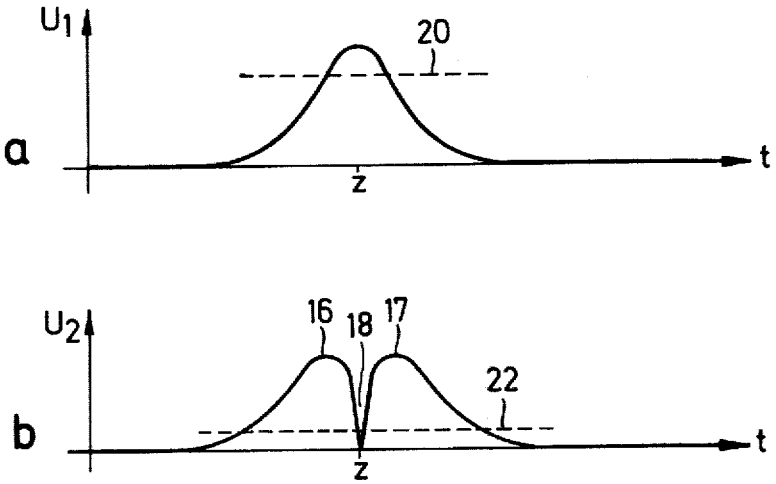

In FIG. 2, the voltage curve $U_1$ at the output of the receiver $E_1$ is shown which results from the passing of the finishing line by the racing car assigned to the corresponding pair of receivers. It is clearly visible that the voltage $U_1$ rises with the approach of the racing car towards the finishing line. It takes its maximum value with the moment of passing z of the finishing line to fade out subsequently again. The exact moment of the passage of the finishing line cannot be readly determined with the voltage $U_1$ because the curve is too flat in the range of the maximum.

In FIG. *2b*, the voltage curve $U_2$ at the output of the receiver $E_2$ is illustrated. The directional characteristic of the induction loop 11 being mainly horizontal, voltage $U_2$ has a first maximum 16 when the transmitter is still in front of the finishing line, and a second maximum 17, when the transmitter is already behind the finishing line.

A considerable drop 18 is in-between. In fact, when the transmitter is exactly in the vertical plane of the induction loop 11, or above the finishing line, no voltage at all is induced in the vertical induction loop 11. As a result, voltage $U_2$ sharply drops to zero for a short time when the finishing line is exactly passed.

A first threshold circuit 19 is connected downward of the receiver $E_1$. The threshold value 20 set in the circuit is relatively high. Threshold circuit 19 supplies an output signal when the voltage $U_1$ exceeds the threshold value 20. As evident from FIG. *2a*, this is so for a certain time before and after the finishing line z is passed.

The second threshold value circuit 21 is adjusted to a relatively low threshold value 22 (FIG. *2b*). Thus, it only always supplies a "1-signal" when the voltage $U_2$ exceeds said threshold value. An inverter 23 is connected downward of the threshold circuit 21. The output signals of the inverter 23 and of the first threshold circuit 19 are supplied to an AND-circuit 24, which supplies a pulse 25 for the passing of the finishing line when the following two requirements are met:

1. the voltage $U_1$ of the first induction loop 10 exceeds the threshold value 20 and
2. the voltage $U_2$ of the second induction loop 11 is below the low threshold value 22.

Said two conditions are only fulfilled during the exact passage of the finishing line z.

As evident, the high directional sensitivity of the vertical induction loop 11 is utilized to determine the exact passage of the finishing line z while the first induction loop 10 is used to limit the larger time range in which a signal 25 for the passing of the finishing line is possible.

Figure 3:
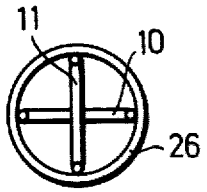
FIG. 3 shows one possibility of securing the induction loop to a tube.

FIG. 3 shows an embodiment of the induction loops 10, 11. They are secured to the internal wall of a plastic tube 26 in such a way that the two induction loops 10 and 11 extend vertically relative to each other. The tube 26 protects the induction loops from damages and deformations. The tube 26 may be embedded in the ground in that the horizontal tube axis extends transversely relative to the racing course.

What is claimed is:

1. A device for determining the moment when the finish line is passed by competitors in a race in which each competitor is provided with a transmitter, said device comprising at least two receiving antennae at the finish line and receivers connected to the receiving antennae, the improvement wherein:

said two receiving antennae are arranged with their directional sensitivities substantially orthogonal, and output signal means, connected to said receivers, for generating an output signal when the signal received by one antenna is above a relatively high first threshold value and the signal received by the other antenna is below a relatively low second threshold value, the occurrence of said output signal indicating that a competitor has passed the finish line.

2. A device according to claim 1 wherein said receiving antennae are induction loops of which one is mounted in a substantially horizontal plane and the other in a substantially vertical plane.

3. A device according to claim 2 wherein the plane of each induction loop crosses the center of the other loop.

4. A device according to claims 2 or 3 wherein the induction loops are embedded in the ground of the racing course with their main axes extending transversely to the direction of motion of the competitors.

5. A device according to claim 1 wherein said receiving antennae are secured to one common support body.

6. A device according to claim 5 wherein said support body is a tube.

7. A system for determining the moment when competitors in a race pass the finish line, each competitor being fitted with a transmitter, said system comprising:

two receiving antennas arranged as the finish line so that the directional sensitivity of the first antenna is substantially vertical and the directional sensitivity of the second antenna is substantially horizontal, first and second receivers connected to the respective first and second antennas, first threshold means, connected to said first receiver, for producing a first output signal when the signal picked up by said first antenna exceeds a first relatively high threshold value, second threshold means, connected to said second receiver, for producing a second output signal when the signal picked up by said second antenna is below a second relatively low threshold value, and logical combining means for producing a single output pulse only when said first and second output signals occur concurrently, said output pulse indicating that a competitor has crossed the finish line.

8. A system according to claim 7 wherein each competitor's transmitter has a uniquely different transmitted signal characteristic, together with:

separate like first and second receivers, first and second threshold means and logical combining means for each competitor, the receivers for each competitor being sensitive only to the signal characteristic unique to that competitor, each logical combining means thereby producing a single output pulse when the respective competitor crosses the finish line.

9. A system for determining the moment when competitors in a race pass the finish line, in which race each competitor is fitted with a transmitter, comprising:

first and second induction loops situated at the finish line so that the directional sensitivities of said loops are orthogonal, and means for providing a single output pulse at the simultaneous occurrence of an induced signal maxima from said first loop and an induced signal minima from said second loop.

* * * * *